United States Patent [19]

Matsubara

[11] Patent Number: 4,614,067

[45] Date of Patent: Sep. 30, 1986

[54] ASSEMBLY OF PREFABRICATED PANEL UNITS HAVING LAPPING WATERTIGHT SEALS

[75] Inventor: Isamu Matsubara, Toyama, Japan

[73] Assignee: Yoshida Kogyo K. K., Tokyo, Japan

[21] Appl. No.: 739,430

[22] Filed: May 30, 1985

[30] Foreign Application Priority Data

Jun. 11, 1984 [JP] Japan ..... 59-86537[U]

[51] Int. Cl.[4] ..... E04B 1/66; E04B 2/88

[52] U.S. Cl. ..... 52/235; 52/396; 52/403; 52/200

[58] Field of Search ..... 52/396–403, 52/235, 200

[56] References Cited

U.S. PATENT DOCUMENTS 3,846,951 11/1974 Paull ..... 52/235

3,893,272 7/1975 Plom ..... 52/235

*Primary Examiner*—J. Karl Bell

*Attorney, Agent, or Firm*—Hill, Van Santen, Steadman & Simpson

[57] ABSTRACT

An assembly of standardized panel units is disclosed as adapted for use as a roof, comprising a series of ridge units of inverted V shaped cross section and an array of planar side units disposed on a sloping plane on each side of the series of ridge units. The vertical joints between the columns of ridge units and side units, and the horizontal joints between the rows of ridge units and side units are all watertightly closed by preformed sealing strips, rather than by the casting of a fluid sealing material, for a longer service life and the greater ease of assemblage. The preformed sealing strips have flanges forming watertight lap joints at their intersections.

8 Claims, 13 Drawing Figures

ASSEMBLY OF PREFABRICATED PANEL UNITS HAVING LAPPING WATERTIGHT SEALS

BACKGROUND OF THE INVENTION

My invention relates to an assembly of prefabricated, standardized panel units to be attached in rows and columns to a building structure to provide a roof, curtain wall or the like. My invention pertains more specifically to such a prefabricated panel assembly having improved means for watertightly sealing the seams between the individual panel units.

In a prefabricated roof assembly, for example, an array of standardized panel units are joined to one another on a sloping plane on either side of a series of standardized ridge units. Each panel unit has a pane or panel of glass or other material peripherally embraced and supported by a rectangular frame. Each ridge unit may take the form of a panel bent into the shape of an inverted V.

The usual conventional practice for watertightly sealing the joints between the constituent panel units of the prefabricated roof assembly has been to cast a fluid sealing compound in place after assembling them on a building structure. This conventional practice is objectionable because of the relatively rapid aging, and the shorter useful life, of the cast-in-place sealing compound. The seals are relatively easy to rupture and allow the intrusion of water during the lifetime of the building, which defect is detrimental to the roof assembly. Another objection is that the casting of a fluid sealing compound in situ is a troublesome and time consuming procedure, requiring skilled labor.

SUMMARY OF THE INVENTION

I have hereby found a solution to the problem of how to watertightly seal the joints between the panel units of a prefabricated panel assembly without the difficulties encountered heretofore.

According to my invention, stated broadly, there is provided a prefabricated panel assembly for use as a roof, curtain wall or the like, comprising a plurality of panel units arranged in rows and colums. A dry vertical sealing strip is mounted between every two horizontally adjoining ones of the panel units for watertightly sealing the joint therebetween. A dry horizontal sealing strip is likewise mounted between every two vertically adjoining ones of the panel units for watertightly sealing the joint therebetween. The vertical and horizontal sealing strips are all adapted to form watertight lap joints at their intersections.

By the term "dry" sealing strips, as used herein and in the claims appended hereto, I mean preformed sealing strips, as contrasted with "wet" or fluid sealing materials that are cast in place. It is also to be noted that the word "vertical", as in the "vertical sealing strip", is not to be taken in the eact sense of the word since the panel units may not necessarily be mounted vertically but on sloping planes, as in the case of roofing.

In accordance with my invention summarized in the foregoing, the vertical and horizontal joints between the constituent panel units of the prefabricated panel assembly can be readily rendered impervious to water by mounting the dry sealing strips therein. The dry sealing strips offer such advantages over the conventional wet seals as the ease of mounting and longer service life.

A problem with the use of dry sealing strips for a prefabricated panel assembly is how to make their intersections watertight without use of additional means that would make their installation difficult. I have overcome this problem by providing flanges to the sealing strips, such that the seals make up watertight lap joints at their intersections. It is therefore possible in accordance with my invention to waterproof both vertical and horizontal seams, as well as their intersections, of the prefabricated panel assembly solely by the dry sealing strips. These sealing strips, moreover, can be readily mounted in interfitting engagement with seal support means attached to the panel units.

The above and other features and advantages of my invention and the manner of realizing them will become more apparent, and the invention itself will best be understood, from a study of the following description and appended claims, with reference had to the attached drawings showing some preferable embodiments of my invention.

DESCRIPTION OF THE PREFERRED EMBODIMENTS

Figure 1:
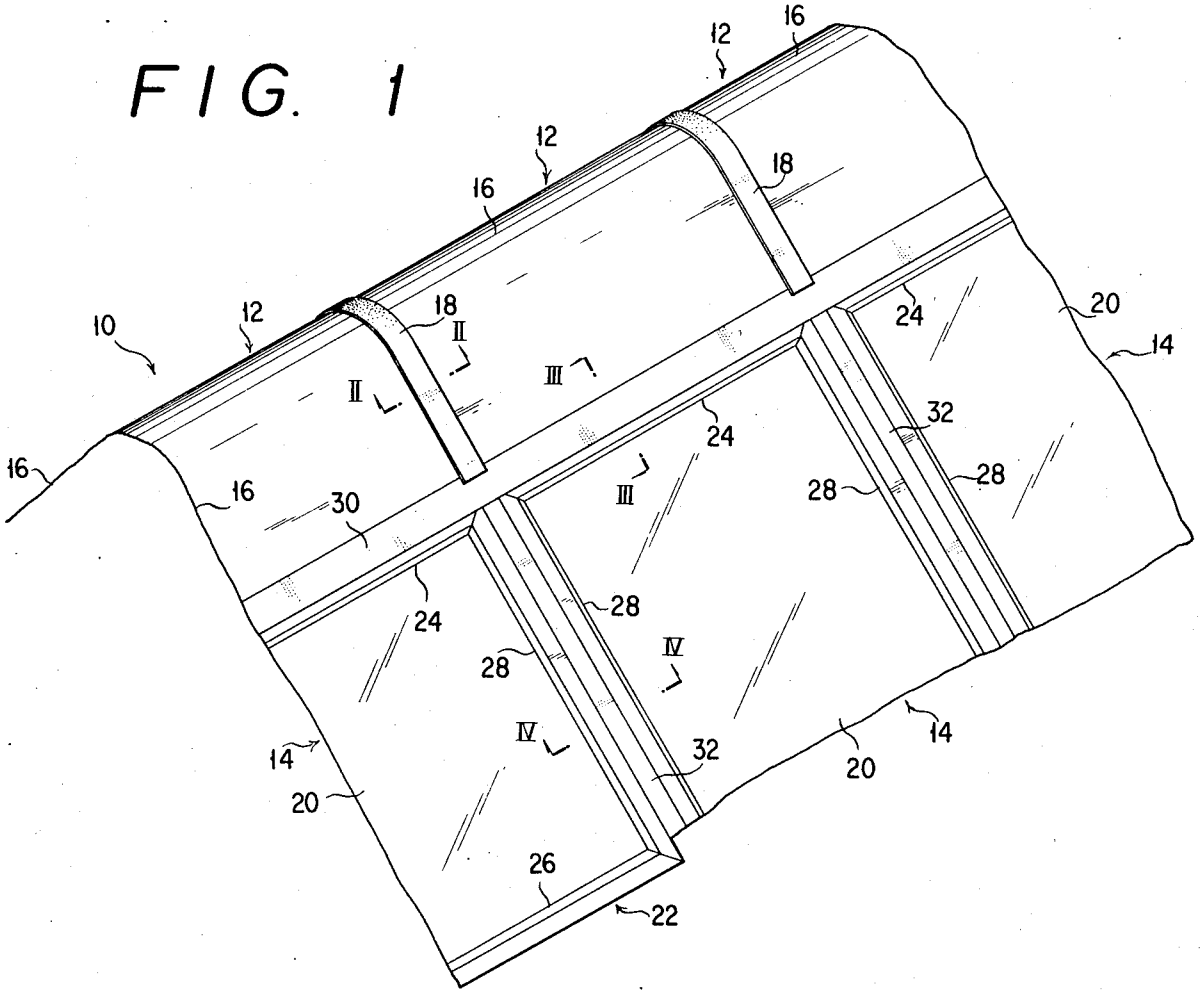
FIG. 1 is a fragmentary perspective view of a prefabricated roof assembly constructed in accordance with the novel concepts of my invention.

I will now describe my invention in detail as embodied in the prefabricated roof assembly of FIG. 1. Generally designated 10, the prefabricated roof assembly comprises a series of standardized ridge units 12 constituting in combination the ridge of the roof assembly, and an array of standardized side units 14 disposed on a declining plane on each side of the ridge. Both ridge units 12 and side units 14 are what I call the panel units in the broader aspect of my invention.

Each including a panel 16 which is bent into the shape of an inverted V, the series of ridge units 12 are joined together via vertical dry sealing strips 18 for watertightly sealing the joints therebetween. Each side unit 14 comprises a panel or pane 20 of glass or like material and a frame 22 extending around and embracing the periphery of the panel. The frame 22 includes a top framing member 24, bottom framing member 26, and a pair of side framing members 38, which are combined rectangularly in any convenient manner. It will further be noted from FIG. 1 that a horizontal dry sealing strip 30 extends throughout the joint between the row of ridge units 12 and each underlying row of side units 14. A vertical dry sealing strip 32 is mounted between every two horizontally adjoining ones of the side units 14. The noted dry sealing strips 18, 30 and 32 can all be fabricated from synthetic rubber or elastomer such as, typically, ethylene propylene rubber (EPR).

In the following description I will use the terms "exterior" and "interior" to refer to the directions toward the outside and toward the inside, respectively, of the roof assembly 10, and the terms "inner" and "outer" to refer to the directions toward and away from, respectively, the middle of each ridge unit 12 or of each side unit 14. Thus, for example, the frame 22 of each side unit 14 is outward of the panel 20. Further, particularly in conjunction with the sealing strips 18, 30 and 32, I will use the terms "overlap" and "underlap" as seen from the exterior of the roof assembly 10. It will therefore be seen that the vertical sealing strips 18 between the ridge units 12 have their bottom end portions overlapping each horizontal sealing strip 30. The vertical sealing strips 32 between the side units 14 have their top end portions underlapping the horizontal sealing strip 30. It is self evident, then, that the vertical sealing strips 32 have their bottom end portions overlapping the underlying horizontal sealing strip which is not shown in FIG. 1.

Figure 2:
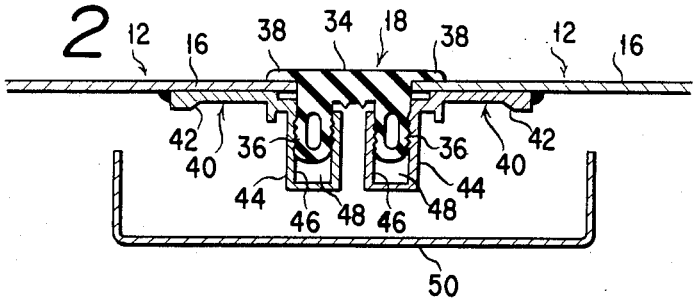
FIG. 2 is a fragmentary, enlarged section through the roof assembly, taken along the line II—II in FIG. 1 and showing in particular one of the dry sealing strips between the ridge units of the roof assembly.

Reference is now directed to FIG. 2 for a more detailed stury of each vertical sealing strip 18 between the ridge units 12. The representative sealing strip 18 seen here includes a web 34 having a pair of tongues 36 projecting interiorly therefrom, and a pair of side flanges 38 formed on both sides of the web in a coplanar relation therewith. The tongues 36 extend throughout the length of the web 34 in a parallel spaced relation with each other.

For mounting the sealing strip 18 between every two adjoining ones of the ridge units 12 there are provided a pair of seal support 40 which are affixed respectively to the opposed marginal marginal edge portions of the ridge units. Each seal support 40 has a flat portion 42 secured to the interior surface of the marginal edge portion of one ridge unit 12, and a U shaped portion 44 defining an exteriorly open groove 46 and projecting outwardly beyond the edge of the ridge unit. The sealing strip 18 has its web 34 caught between the opposed edges of the two adjoining ridge units 12, its pair of tongues 36 snugly engaged respectively in the grooves 46 in the two opposed pair of seal supports 40, and its pair of side flanges 38 held fast against the exterior surfaces of the marginal edge portions of the ridge units. The tongues 36 are not bottomed against the grooves 46 but provide spaces 48, so that the grooves 46 serve also as conduits for the drainage of rainwater. An upwardly open catch pan 50 may be mounted interiorly of the sealing strip 18 for collecting water that may unavoidablly leak through the seal.

Figure 3:
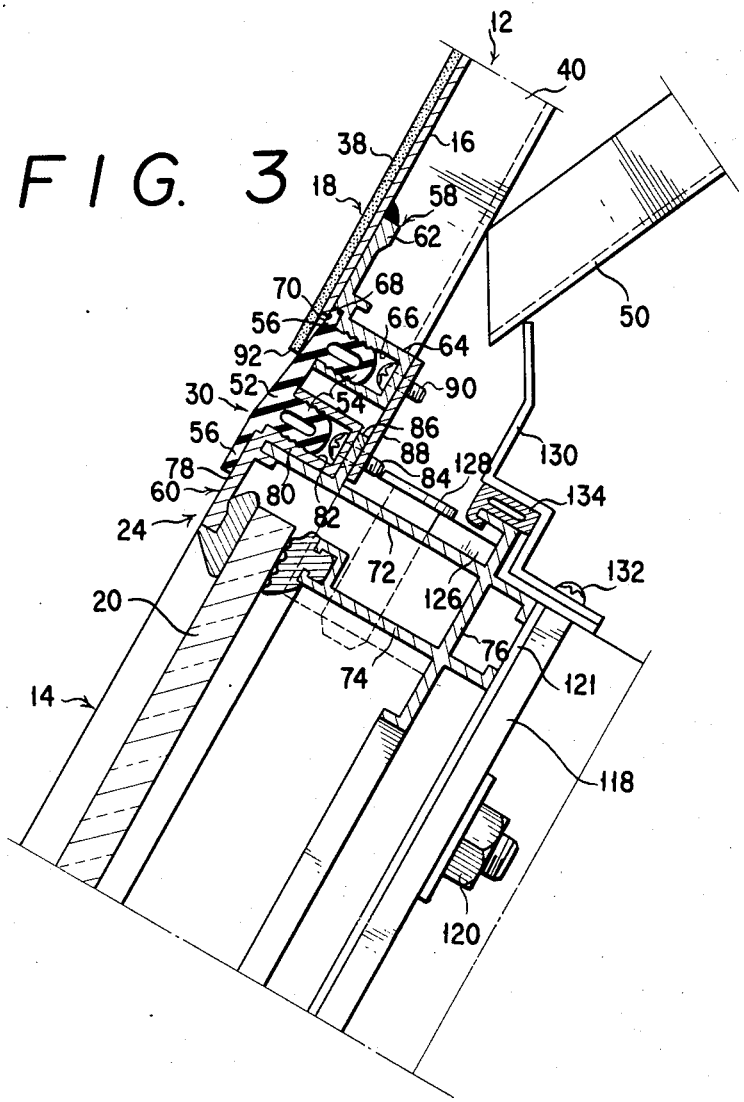
FIG. 3 is also a fragmentary, enlarged section through the roof assembly, taken along the line III—III in FIG. 1 and showing in particular one of the horizontal dry sealing strips between the ridge units and side units of the roof assembly.

In FIG. 3 I have shown a cross sectional representation of one of the horizontal sealing strips 30 and the neighboring parts of the roof assembly 10. Each sealing strip 30 also has a web 52 having a pair of tongues 54 projecting interiorly therefrom, and a pair of side flanges 56 formed on the opposite sides of the web substantially in a coplanar relation therewith. The tongues 54 extend throughout the length of the sealing strip 30 in a parallel spaced relation with each other.

For mounting the sealing strip 30 there are provided an upper seal support 58 affixed to the ridge unit 12, and a lower seal support 60 affixed to the side unit 14. The upper seal support 58 comprises a flat portion 62 secured to the interior surface of the lower marginal edge portion of the panel 16 of the ridge unit 12, and a U shaped portion 64 defining an exteriorly open groove 66 and projecting downwardly beyond the edge of the panel 16. The upper seal support 58 has a recess 68 formed in and extending along the junction between its flat portion 62 and U shaped portion 64, thereby providing a groove 70 between itself and the bottom marginal edge portion of the panel 16 of the ridge unit 12.

The lower seal support 60 not only serves for supporting the sealing strip 30 in coaction with the upper seal support 58 but also constitutes a part of the top framing member 24 of the side unit 14. The top framing member 24 is generally U shaped, opening exteriorly, and comprises an outer or upper wall 72, an inner or lower wall 74 spaced inwardly from the outer wall, and an interior wall 76 bridging the outer and inner walls. The lower seal support 60 comprises a flat portion 78 disposed exteriorly of the top framing member 24, and a U shaped portion 80 defining a groove 82 and disposed outwardly or upwardly of the top framing member. The U shaped portion 80 of the lower seal support 60 is screwed at 84 to a fin 86 on the outer wall 72 of the top framing member 24. The screws 84 serve also to fasten a connector plate 88 to the fin 86, which connector plate is further screwed at 90 to the U shaped portion 64 of the upper seal support 58. The flat portion 78 of the lower seal support 60 coacts with the inner wall 74 of the top framing member 24 to embracingly engage the top peripheral edge portion of the panel 20 of the side unit 14.

The pair of tongues 54 of the sealing strip 30 are snugly engaged respectively in the grooves 66 and 82 in the U shaped portions 64 and 80 of the seal supports 58 and 60. One of the side flanges 56 of the sealing strip 30 is closely engaged in the groove 70 and thus held in an underlapping relation to the panel 16 of the ridge unit 12. The other side flange 56 of the sealing strip 30 overlaps the flat portion 78 of the lower seal support 60.

It will further be observed from FIG. 3 that the vertical sealing strip 18 between the ridge units 12 has its pair of tongues 36 cut away at its bottom end portion. The remaining bottom end portion of the web 34 of the sealing strip 18 serves as a bottom flange 92 overlapping the horizontal sealing strip 30.

Figure 4:
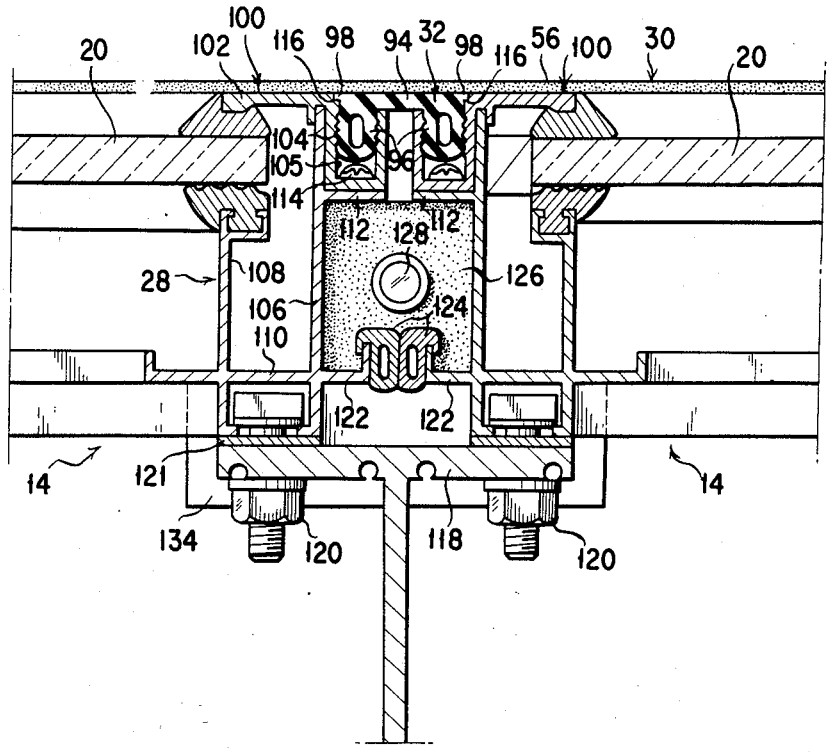
FIG. 4 is also a fragmentary, enlarged section through the roof assembly, taken along the line IV—IV in FIG. 1 and showing in particular one of the vertical dry sealing strips between the side units of the roof assembly.

FIG. 4 is a cross sectional illustration of one of the vertical sealing strips 32 between the side units 20, as well as of the adjacent parts of two adjoining side units. The representative vertical sealing strip 32 includes a web 94 having a pair of tongues 96 projecting interiorly therefrom and extending longitudinally of the sealing strip in a parallel spaced relation to each other, and a pair of side flanges 98 extending along the opposite sides of the web 94 in a coplanar relation thereto.

The vertical sealing strip 32 is mounted between the two neighboring side units 14 via a pair of seal supports 100. Each seal support 100 comprises a flat portion 102 disposed exteriorly of one of the side framing members 28 of one side unit 14, and a U shaped portion 104 defining an exterirorly open groove 105 and disposed outwardly of the side framing member 28. Each side framing member 28 comprises an outer wall 106, an inner wall 108 spaced inwardly from the outer wall, and an interior wall 110 extending right angularly between the outer and inner walls at their interior ends. The outer wall 106 has a fin 112 projecting outwardly therefrom, to which the U shaped portion 104 of one seal support 100 is screwed at 114. The flat portion 102 of each seal support 100 coacts with the inner wall 108 of one side framing member 28 to engage and support a lateral peripheral edge portion of the panel 20.

The vertical sealing strip 32 is mounted in position by having its pair of tongues 96 snugly engaged respectively in the grooves 105 in the U shaped portions 104 of the neighboring pair of seal supports 100. The pair of side flanges 98 of the sealing strip 32 are closely engaged respectively in recesses 116 each formed at the junction between the flat portion 102 and U shaped portion 104 of one seal support 100. Thus the side flanges 98 overlap the frames 28 of the side units 14, although in fact the exterior surfaces of these side flanges are flush with the exterior surfaces of the flat portions 102 of the seal supports 100 in this embodiment.

A comparison of FIG. 4 with FIG. 3 will reveal that the horizontal sealing strip 30 has its lower side flange 56 overlapping each vertical sealing strip 32 at each intersection of the vertical and horizontal sealing strips.

It will also be noted from FIGS. 3 and 4 that the opposed side frame members 28 of every two neighboring side units 14 are rigidly interconnected by a connector strip 118 arranged interiorly of the side frame members and bolted thereto at 120 via packings 121. The opposed outer walls 106 of these side framing members 28 have L shaped flanges 122 extending outwardly therefrom toward each other and arranged interiorly of the fins 112. An additional pair of sealing strips 124 are mounted to the L shaped flanges 122 and are pressed against each other. A body 126 of material permeable to water is filled in the space bounded by the outer walls 106, fins 112, and L shaped flanges 122 of the opposed side frame members 28. An end plug 128 is forced centrally into the permeable body 126.

Seen at 130 in FIG. 3 is a splash guard screwed at 132 to the connector strip 118, with a packing 134 installed between this splash guard and the top frame members 24. The splash guard 130 has its top end held against the catch pan 50 and functions to conduct the rain water from the catch pan down to the permeable body 126, preventing such water from splashing interiorly of the roof assembly 10. The rainwater is to flow from the permeable body 126 on to the spaces defined interiorly of the panels 20 of the side units 14 and held under atmospheric pressure.

Figure 5:
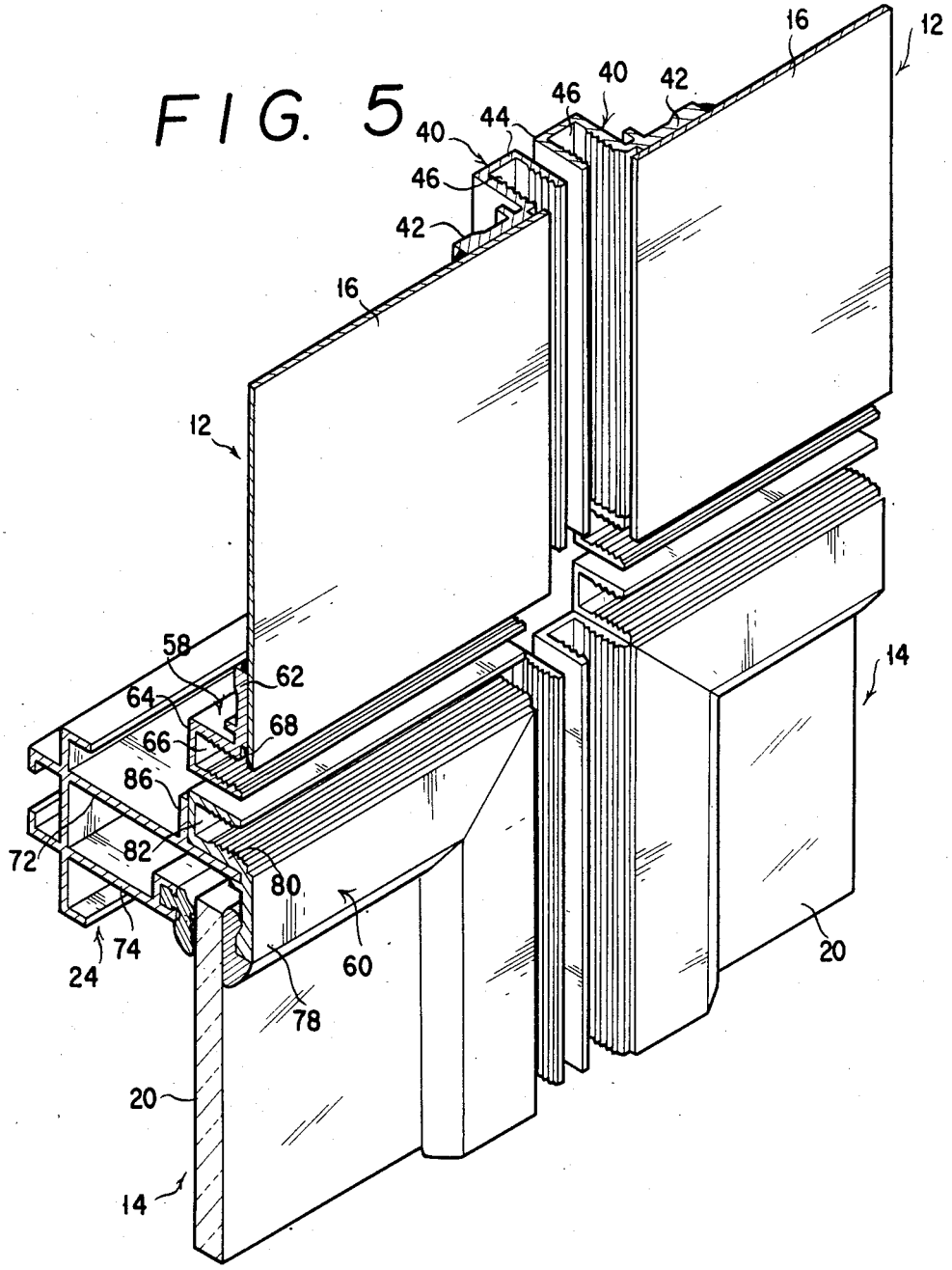
FIG. 5 is a fragmentary perspective view showing two ridge units and two side units together with the seal supports and other associated means of the roof assembly but not showing the dry sealing strips to clearly reveal the other parts of the roof assembly.

I have illustrated in FIG. 5, in perspective and fragmentarily, two of the ridge units 12 and two of the side units 14 of the roof assembly 10 in their relative positions. This figure does not show, however, the dry sealing strips 18, 30 and 32 to clearly reveal the other parts of the roof assembly 10. A better understanding of the constructions of the ridge units 12 and side units 14 will be had from a consideration of this figure.

Figure 6:
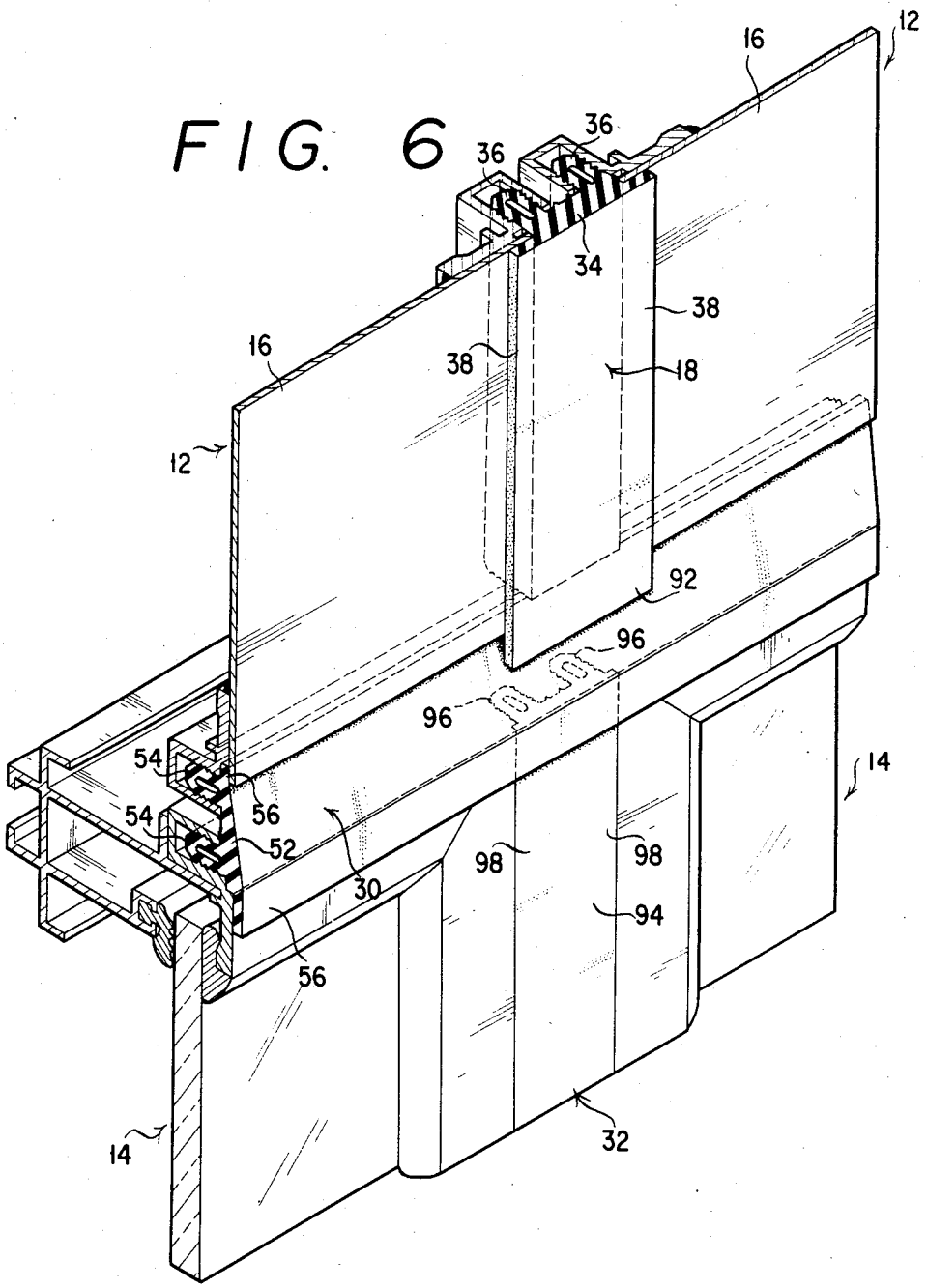
FIG. 6 is a view similar to FIG. 5 except that the vertical and horizontal dry sealing strips are shown mounted in position on the roof assembly.
Figure 7:
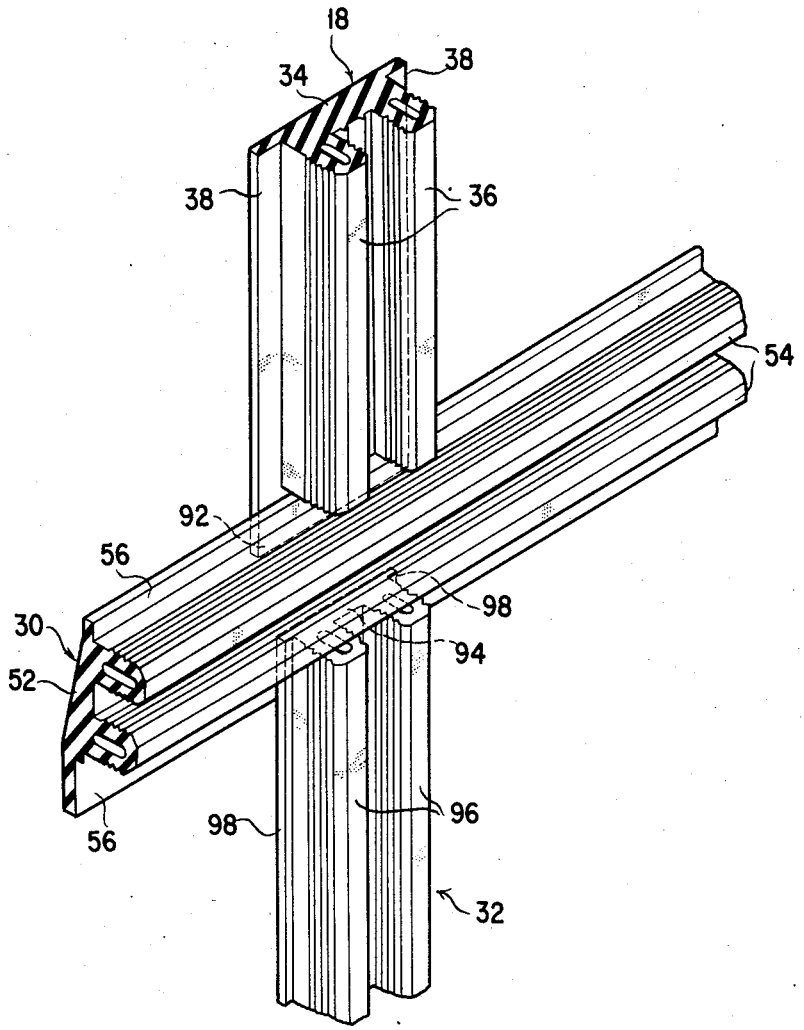
FIG. 7 is a fragmentary perspective view of the vertical and horizontal dry sealing strips of the roof assembly, showing in particular the watertight lap joints formed at one intersection of the sealing strips.

FIGS. 6 and 7 best illustrate the watertight lap joints at each intersection of the vertical and horizontal sealing strips 18, 30 and 32 of the roof assembly 10 in accordance with my invention. Each vertical sealing strip 18 between the ridge unit 12 has its bottom flange 92 overlapping the upper side flange 56 of the underlying horizontal sealing strip 30. The lower side flange 56 of this horizontal sealing strip 30 overlaps each vertical sealing strip 32 between the side units 14. Thus, despite the use of the dry sealing strips in accordance with my invention, their intersections can be made waterproof for all practical purposes merely by the lap joints of the sealing strips.

SECOND FORM

Figure 8:
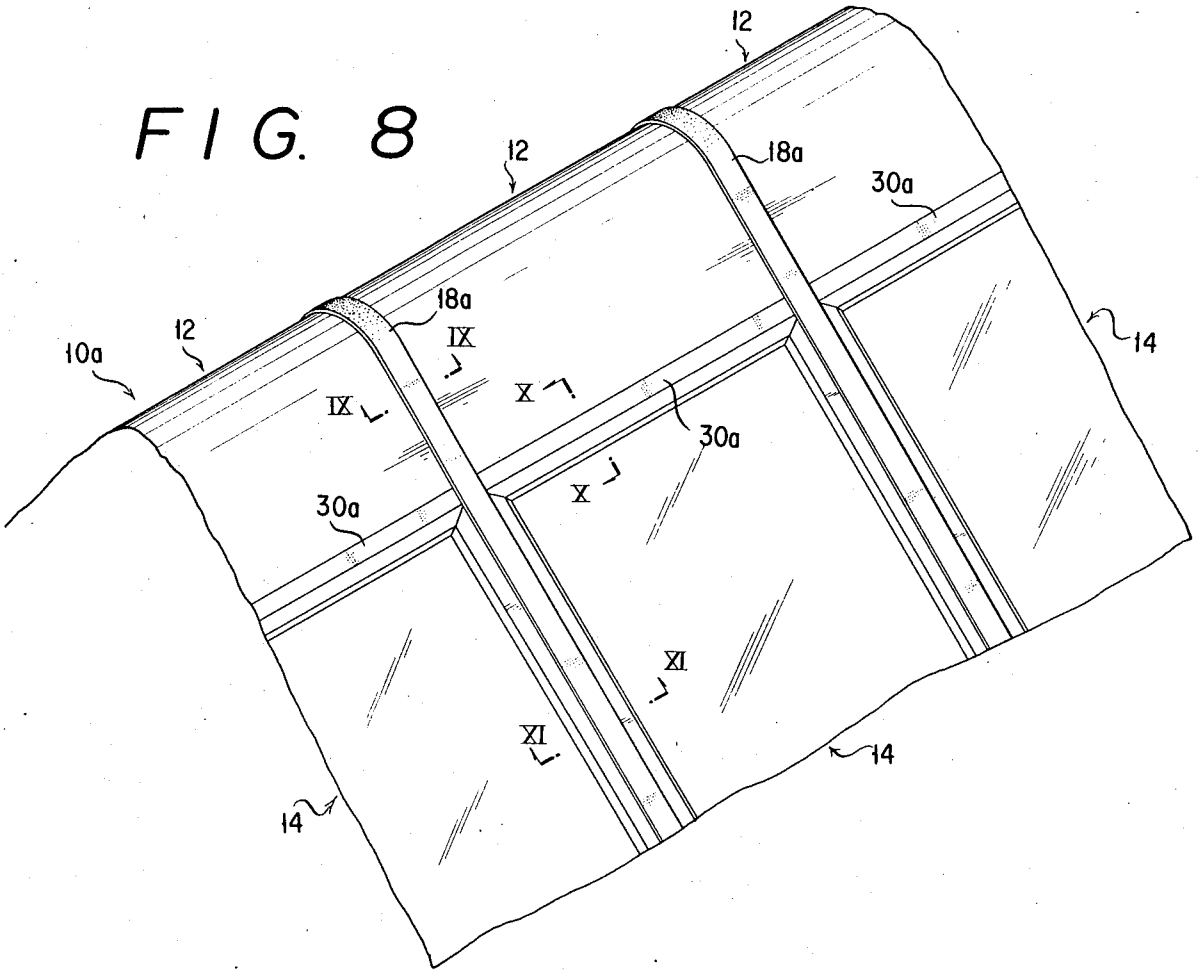
FIG. 8 is a fragmentary perspective view of another preferred form of the prefabricated roof assembly embodying my invention.

FIG. 8 shows another prefabricated roof assembly **10*a* in accordance with my invention, and FIGS. 9 through 13 are detailed illustrations of the various parts of the roof assembly 10*a*. This alternative roof assembly differs from the roof assembly 10 in that each vertical dry sealing strip 18*a* extends throughout the joint between every two adjoining columns of the ridge units 12 and side units 14, and that each horizontal dry sealing strip 30*a* extends between one ridge unit 12 and one side unit 14**, as well as between every two vertically adjoining side units.

Figure 9:
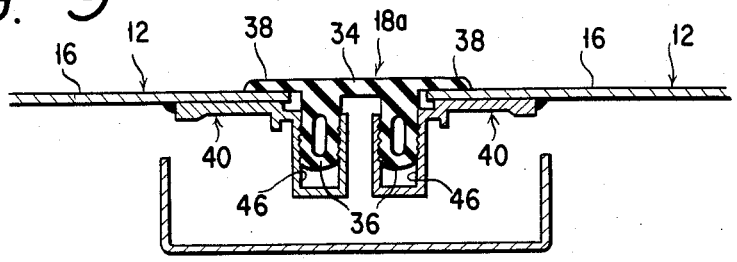
FIG. 9 is a fragmentary, enlarged section through the roof assembly of FIG. 8, taken along the line IX—IX therein and showing in particular one of the dry sealing strips between the ridge units of the roof assembly.
Figure 11:
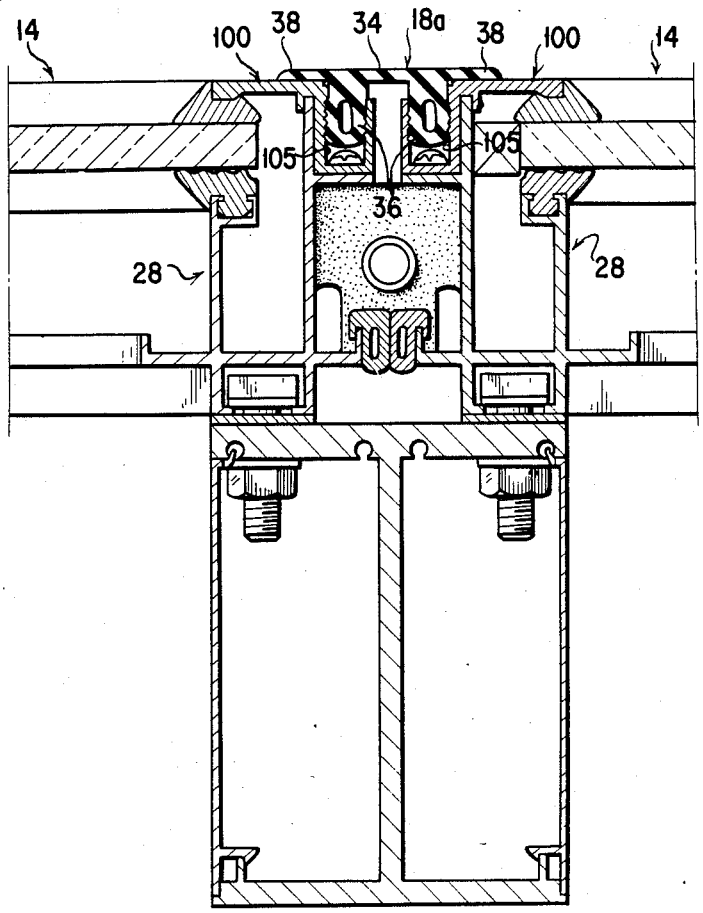
FIG. 11 is also a fragmentary, enlarged section through the roof assembly of FIG. 8, taken along the line XI—XI therein and showing in particular one of the vertical dry sealing strips between the side units of the roof assembly.

FIGS. 9 and 11 indicate that each vertical sealing strip **18*a* is mounted between the ridge units 12 and between the side units 14 the same way as the vertical sealing strips 18 and 32 of the roof assembly 10 are mounted respectively between the ridge units 12 and between the side units 14. The pair of tongues 36 of each vertical sealing strip 18*a* are engaged in the grooves 46 in the seal supports 40 affixed to the panels 16 of the ridge units 12, and in the grooves 105 in the seal supports 100 affixed to the side framing members 28 of the side units 20. The pair of flanges 38 of each vertical sealing strip 18*a* overlap the panels 16 of the ridge units 12 and the seal supports 100 (constituting parts of the side framing members 28) of the side units 14**.

Figure 10:
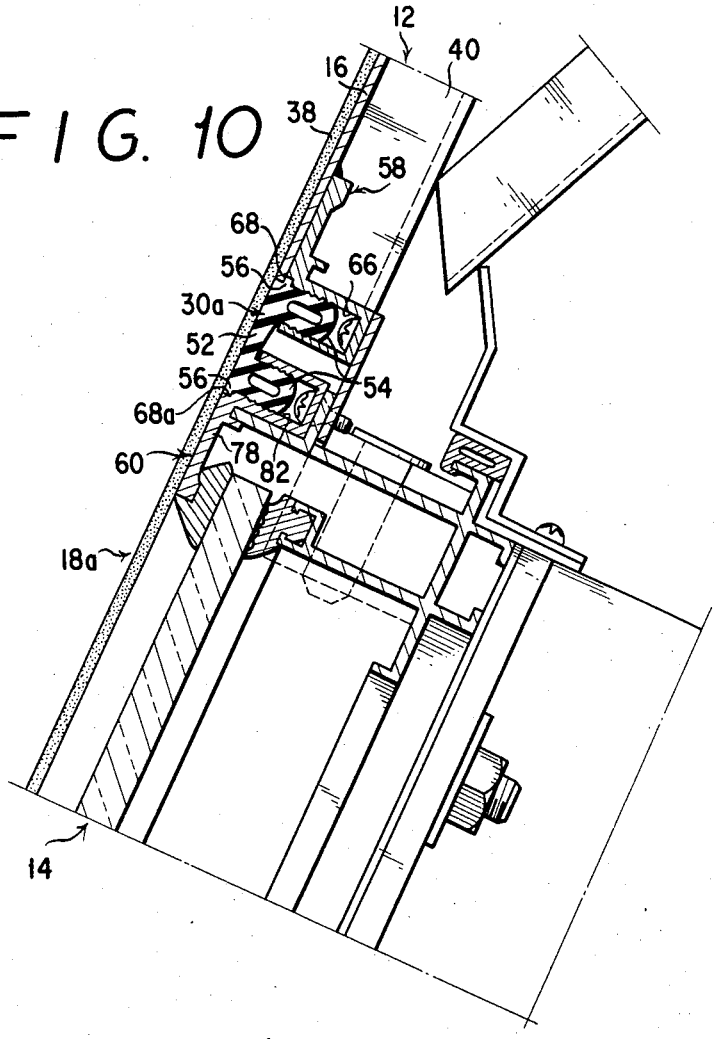
FIG. 10 is also a fragmentary, enlarged section through the roof assembly of FIG. 8, taken along the line X—X therein and showing in particular one of the horizontal dry sealing strips between the ridge units and side units of the roof assembly.

As will be seen from FIG. 10, each horizontal sealing strip **30*a* is mounted between one ridge unit 12 and one side unit 14 substantially the same way as each horizontal sealing strip 30 of the roof assembly 10 is mounted between the rows of ridge units and side units. The pair of tongues 54 of each horizontal sealing strip 30***a* are engaged respectively in the groove 66 in the seal support 58 on one ridge unit 12 and in the groove 82 in the seal support 60 on one side unit 14. The upper side flange 56 of each horizontal sealing strip 30*a* is engaged in the recess 68 in the seal support 58 and underlaps the panel 16 of one ridge unit 12. The lower side flange 56 of each horizontal sealing strip 30*a* is engaged in a recess 68*a* in the seal support 60 and substantially overlaps its flap portion 78. Further, in spite of these underlapping and overlapping relations of the side flanges 56 of each horizontal sealing strip 30*a*, the flanges are flush with the panel 16 of the overlying ridge unit 12 and with the flat portion 78 of the seal support 60 of the underlying side unit 14.

Figure 12:
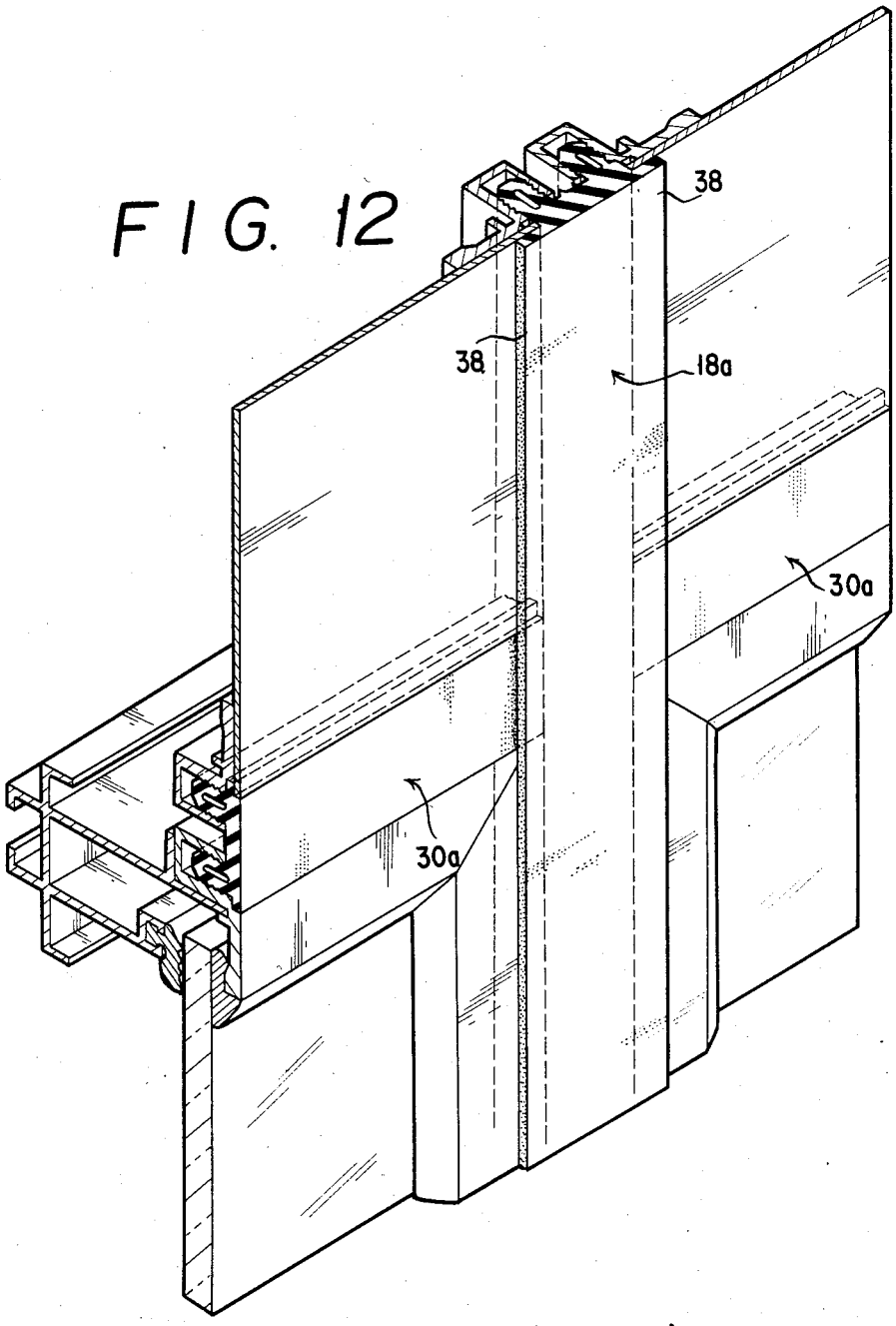
FIG. 12 is a fragmentary perspective view showing two ridge units and two side units of the roof assembly of FIG. 8 together with the vertical and horizontal dry sealing strips at one of their intersections, and other associated means.
Figure 13:
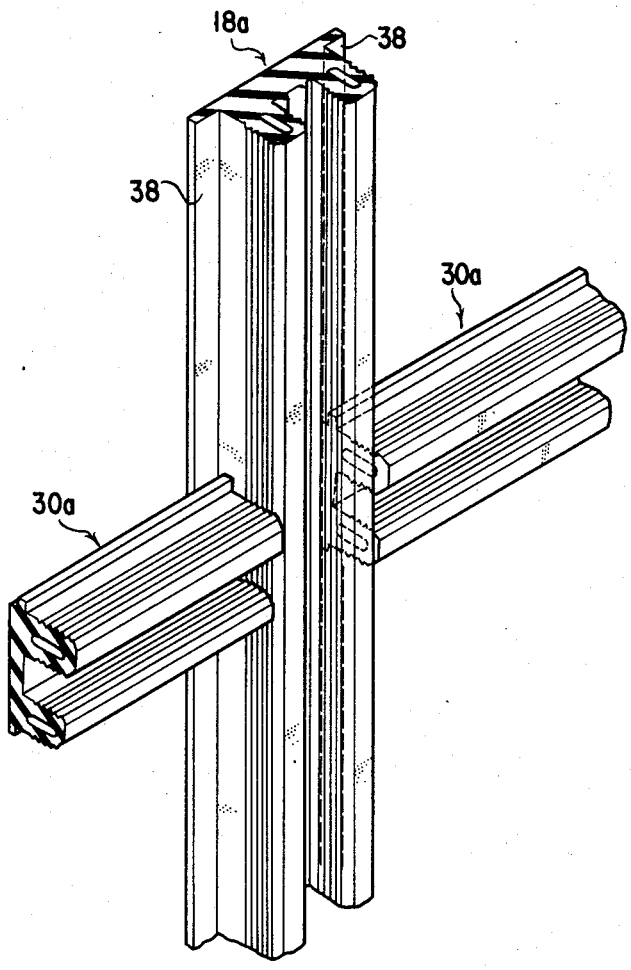
FIG. 13 is a fragmentary perspective view of the vertical and horizontal dry sealing strips of the roof assembly of FIG. 8, showing in particular the watertight lap joints formed at one intersection of the sealing strips.

Thus, as clearly shown in FIGS. 12 and 13, the pair of side flanges 38 of each vertical sealing strip 18*a* overlap the end portions of the two adjoining horizontal sealing strips 30*a*, thereby forming watertight lap joints at their intersections. The alternative roof assembly 10*a* is akin to the first described roof assembly 10 in the other details of construction. The advantages accruing from the roof assembly 10*a* are also as set forth above in connection with the roof assembly 10.

Although I have shown and described my invention as adapted specifically for the roof assembly of two diferent forms, I recognize that my invention is applicable to other types of prefabricated panel assemblies comprising arrays of standardized panel units. Accordingly, my invention is not to be limited by the exact details of the embodiments disclosed herein but only by the terms of the claims which follow.

I claim:

1. A prefabricated panel assembly for use as a roof, curtain wall or the like, comprising:

(a) a plurality of panel units arranged in rows and columns;

(b) seal support means secured to and extending along the periphery of each panel unit;

(c) a plurality of dry vertical sealing strips for watertightly sealing the vertical joints between the panel units, each vertical sealing strip having a web arranged between two horizontally adjoining panel units and adapted to engage with the seal support means, each vertical sealing strip further having flange means in a lapping relation with two horizontally adjoining panel units;

(d) a plurality of dry horizontal sealing strips for watertightly sealing the horizontal joints between the panel units, each horizontal sealing strip having a web arranged between two vertically adjoining panel units and adapted to engage with the seal support means, each horizontal sealing strip further having flange means in a lapping relation with two vertically adjoining panel units;

(e) the flange means of the vertical and horizontal sealing strips being adapted to form watertight lap joints at the intersections of the vertical and horizontal sealing strips; and wherein each horizontal sealing strip extends throughout the joint between every two adjoining rows of panel units, and wherein each vertical sealing strip is mounted between every two horizontally adjoining panel units, the flange means of each horizontal sealing strip comprising an upper flange underlapping the overlying row of panel units, and a lower flange overlapping the underlying row of panel units and the underlying vertical sealing strip, the flange means of each vertical sealing strip comprising a pair of side flanges overlapping respectively two horizontally adjoining panel units, and a bottom flange overlapping the underlying horizontal sealing strip.

2. The prefabricated panel assembly as recited in claim 1, wherein the web of each of the vertical and horizontal sealing strips has a pair of tongues projecting interiorly therefrom and extending longitudinally thereof in a parallel spaced relation to each other for engagement in respective grooves defined by the seal support means.

3. A prefabricated panel assembly for use as a roof, curtain wall or the like, comprising:

(a) a plurality of panel units arranged in rows and columns;

(b) seal support means secured to and extending along the periphery of each panel unit;

(c) a plurality of dry vertical sealing strips for watertightly sealing the vertical joints between the panel units, each vertical sealing strip having a web arranged between two horizontally adjoining panel units and adapted to engage with the seal support means, each vertical sealing strip further having flange means in a lapping relation with two horizontally adjoining panel units;

(d) a plurality of dry horizontal sealing strips for watertightly sealing the horizontal joints between the panel units, each horizontal sealing strip having a web arranged between two vertically adjoining panel units and adapted to engage with the seal support means, each horizontal sealing strip further having flange means in a lapping relation with two vertically adjoining panel units;

(e) the flange means of the vertical and horizontal sealing strips being adapted to form watertight lap joints at the intersections of the vertical and horizontal sealing strips; and wherein each vertical sealing strip extends throughout the joint between every two adjoining columns of panel units, and wherein each horizontal sealing strip is mounted between every two vertically adjoining panel units, the flange means of each vertical sealing strip comprising a pair of side flanges overlapping respectively two adjoining columns of panel units and the adjoining horizontal sealing strips, the flange means of each horizontal sealing strip comprising an upper flange underlapping the overlying row of panel units, and a lower flange overlapping the underlying row of panel units.

4. The prefabricated panel assembly as recited in claim 3, wherein the web of each of the vertical and horizontal sealing strips has a pair of tongues projecting interiorly therefrom and extending longitudinally thereof in a parallel spaced relation to each other for engagement in respective grooves defined by the seal support means.

5. A prefabricated roof assembly comprising:

(a) a row of ridge units each having a panel of substantially inverted U shaped cross section;

(b) a plurality of side units arranged in rows and columns on a sloping plane on each side of the row of ridge units, each side unit having a second panel and a frame extending along and embracing the periphery of the second panel;

(c) seal support means secured to and extending along the periphery of each ridge unit and of each unit;

(d) a plurality of dry vertical sealing strips for watertightly sealing the vertical joints between the ridge units and between the side units, each vertical sealing strip having a web arranged between two horizontally adjoining ridge units or between two horizontally adjoining side units and adapted to engage with the seal support means, each vertical sealing strip further having flange means in a lapping relation with two horizontally adjoining ridge units or with two horizontally adjoining side units;

(e) a plurality of dry horizontal sealing strips for watertightly sealing the horizontal joints between the ridge units and the side units and between the rows of side units, each horizontal sealing strip having a web arranged between one ridge unit and one underlying side unit or between two vertically adjoining side units and adapted to engage with the seal support means, each horizontal sealing strip further having flange means in a lapping relation with one ridge unit and one underlying side unit or with two vertically adjoining side units;

(f) the flange means of the vertical and horizontal sealing strips being adapted to form watertight lap joints at the intersections of the vertical and horizontal sealings strips; and wherein each horizontal sealing strip extends throughout the joint between the row of ridge unit and one adjoining row of side units or between every two adjoining rows of side units, and wherein each vertical sealing strip is mounted between every two adjoining ridge units or between every two horizontally adjoining side units, the flange means of each horizontal sealing strip comprising an upper flange underlapping the row of ridge units or one row of side units, and a lower flange overlapping the underlying row of side units and the underlying vertical sealing strips, the flange means of vertical sealing strip comprising a pair of side flanges overlapping respectively two adjoining ridge units or two horizontally adjoining side units, and a bottom flange overlapping the underlying horizontal sealing strip.

6. The prefabricated roof assembly as recited in claim 5, wherein the web of each of the vertical and horizontal sealing strips has a pair of tongues projecting interiorly therefrom and extending longitudinally thereof in a parallel spaced relation to each other for engagement in respective grooves defined by the seal support means.

7. A prefabricated roof assembly comprising:

(a) a row of ridge units each having a panel of substantially inverted U shaped cross section;

(b) a plurality of side units arranged in rows and columns on a sloping plane on each side of the row or ridge units, each side unit having a second panel and a frame extending along and embracing the periphery of the second panel;

(c) seal support means secured to and extending along the periphery of each ridge unit aand of each unit;

(d) a plurality of dry vertical sealing strips for watertightly sealing the vertical joints between the ridge units and between the side units, each vertical sealing strip having a web arranged between two horizontally adjoining ridge units or between two horizontally adjoining side units and adapted to engage with the seal support means, each vertical sealing strip further having flange means in a lapping relation with two horizontally adjoining ridge units or with two horizontally adjoining side units;

(e) a plurality of dry horizontal sealing strips for watertightly sealing the horizontal joints between the ridge units and the side units and between the rows of side units, each horizontal sealing strip having a web arranged between one ridge unit and one underlying side unit or between two vertically adjoining side units and adapted to engage with the seal support means, each horizontal sealing strip further having flange means in a lapping relation with one ridge unit and one underlying side unit or with two vertically adjoining side units;

(f) the flange means of the vertical and horizontal sealing strips being adapted to form watertight lap joints at the intersections of the vertical and horizontal sealings strips; and wherein each vertical sealing strip extends throughout the joint between every two adjoining columns of ridge units and side units, and wherein each horizontal sealing strip is mounted between one ridge unit and one underlying side unit or between every two vertically adjoining side units, the flange means of each vertical sealing strip comprising a pair of side flanges overlapping respectively two adjoining columns of ridge units and side units and the adjoining horizontal sealing strips, the flange means of each horizontal sealing strip comprising an upper flange underlapping the row of ridge units or the overlying row of side units, and a lower flange overlapping the underlying row of side units.

8. The prefabricated roof assembly as recited in claim 7, wherein the web of each of the vertical and horizontal sealing strips has a pair of tongues projecting interiorly therefrom and extending longitudinally thereof in a parallel spaced relation to each other for engagement in respective grooves defined by the seal support means.

* * * * *